US008608163B1

(12) United States Patent
Herrmann et al.

(10) Patent No.: US 8,608,163 B1
(45) Date of Patent: Dec. 17, 2013

(54) METHOD AND APPARATUS FOR CONSTANT VELOCITY CUT-SHEET INVERSION IN A PRINTING SYSTEM

(75) Inventors: Douglas K. Herrmann, Webster, NY (US); Bruce Allen Thompson, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/529,365

(22) Filed: Jun. 21, 2012

(51) Int. Cl.
*B65H 5/00* (2006.01)

(52) U.S. Cl.
USPC ..... 271/225; 271/184

(58) Field of Classification Search
CPC ..... B65H 2301/33; B65H 2301/332; B65H 2301/3321; B65H 2301/33212; B65H 2301/33214; B65H 2301/33216; B65H 2301/3322; B65H 2301/33222; B65H 2301/33224; B65H 2301/333; B65H 2301/331; B65H 2301/33312
USPC ..... 271/225, 184, 185, 186
See application file for complete search history.

(56) References Cited

U.S. PATENT DOCUMENTS

| | | | | | |
|---|---|---|---|---|---|
| 3,206,089 | A * | 9/1965 | Huck | 226/40 |
| 4,154,386 | A * | 5/1979 | Kawada | 226/91 |
| 4,788,846 | A * | 12/1988 | Morita et al. | 72/160 |
| 4,844,442 | A * | 7/1989 | Gammerler | 271/225 |
| 5,108,022 | A * | 4/1992 | Birkmair et al. | 242/615.21 |
| 5,333,851 | A * | 8/1994 | Kulpa | 271/225 |
| 5,467,179 | A * | 11/1995 | Boeck et al. | 399/384 |
| 5,996,491 | A * | 12/1999 | Kishine et al. | 101/223 |
| RE38,867 | E * | 11/2005 | Kusters | 271/225 |
| 7,021,184 | B2 * | 4/2006 | Sussmeier et al. | 83/155 |
| 7,988,147 | B2 * | 8/2011 | Ito | 271/225 |
| 8,052,143 | B2 * | 11/2011 | Yamamoto et al. | 271/225 |

* cited by examiner

*Primary Examiner* — Kaitlin Joerger
(74) *Attorney, Agent, or Firm* — Ronald E. Prass, Jr.; Prass LLP

(57) ABSTRACT

An approach is provided for inverting a sheeted substrate processed by a printing system while continuously running the sheeted substrate through the printing system without stopping. The approach involves a series of rolls that cause an orientation of the sheeted substrate to be changed such that the sheeted substrate may be returned to a first process path when inverted for duplex printing, or otherwise diverted to a bypass path.

10 Claims, 3 Drawing Sheets

METHOD AND APPARATUS FOR CONSTANT VELOCITY CUT-SHEET INVERSION IN A PRINTING SYSTEM

FIELD OF DISCLOSURE

The disclosure relates to an apparatus, method and system for inverting a sheeted substrate while continuously running the sheeted substrate through a printing system.

BACKGROUND

Conventional printing systems invert sheeted substrates to perform duplex printing. Conventional inversion of a sheeted substrate involves advancing a substrate into an inversion baffle, stopping the movement of the sheeted substrate in the inversion baffle, changing the direction of movement of the sheeted substrate to move the sheeted substrate out of the inversion baffle, and restarting the movement of the sheeted substrate to change a side of the sheeted substrate to be processed (i.e. receive a printed image). How the sheeted substrate is stopped is machine specific. But, because the movement of the sheeted substrate is stopped, and then restarted in another direction, the sheeted substrate must then be accelerated to reach a process velocity. Printing service providers continue to increase printing process speeds to meet printing service demands. However, continually increasing process speeds causes the associated accelerations that occur when restarting the movement of the sheeted substrate to rise. The increased speeds and accelerations often lead to handling issues such as paper jams and image defects such as marring or smearing of the image, for example. Additionally, because conventional printing systems must stop and restart the movement of a sheeted substrate to invert the sheeted substrate, a maximum process speeds are limited.

SUMMARY

Therefore, there is a need for an approach to invert him a sheeted substrate while continuously running the sheeted substrate through a printing system.

According to one embodiment, a method useful in printing comprises causing, at least in part, a sheeted substrate having a first surface and a second surface to be fed in a first process direction along a first process path in a first plane, the sheeted substrate having a first orientation in which the first surface faces a first direction and the second surface faces a second direction. The method also comprises causing, at least in part, the sheeted substrate to be fed in a second process direction along a second process path perpendicular to the first process direction in a second plane. A first roll having a first roll center axis oriented at about a 45° angle with respect to the first process direction is configured to cause a first diversion of the sheeted substrate from the first process path to the second process path, and cause a first inversion of the sheeted substrate from the first orientation to a second orientation in which the first surface faces the second direction and the second surface faces the first direction.

According to another embodiment, an apparatus useful in printing comprises a first process path in a first plane along which a sheeted substrate having a first surface and a second surface is fed in a first process direction, the sheeted substrate having a first orientation in which the first surface faces a first direction and the second surface faces a second direction. The apparatus also comprises a first roll having a first roll center axis oriented at about a 45° angle with respect to the first process direction. The apparatus further comprises a second process path perpendicular to the first process direction along which the sheeted substrate is fed in a second process direction and in a second plane. The first roll is configured to cause a first diversion of the sheeted substrate from the first process path to the second process path, and cause a first inversion of the sheeted substrate from the first orientation to a second orientation in which the first surface faces the second direction and the second surface faces the first direction.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments of the invention are illustrated by way of example, and not by way of limitation, in the figures of the accompanying drawings.

DETAILED DESCRIPTION

Examples of a method, apparatus, and computer program for inverting a sheeted substrate while continuously running the sheeted substrate through a printing system are disclosed. In the following description, for the purposes of explanation, numerous specific details are set forth in order to provide a thorough understanding of the embodiments. It is apparent, however, to one skilled in the art that the embodiments may be practiced without these specific details or with an equivalent arrangement. In other instances, well-known structures and devices are shown in block diagram form in order to avoid unnecessarily obscuring the embodiments.

Figure 1:
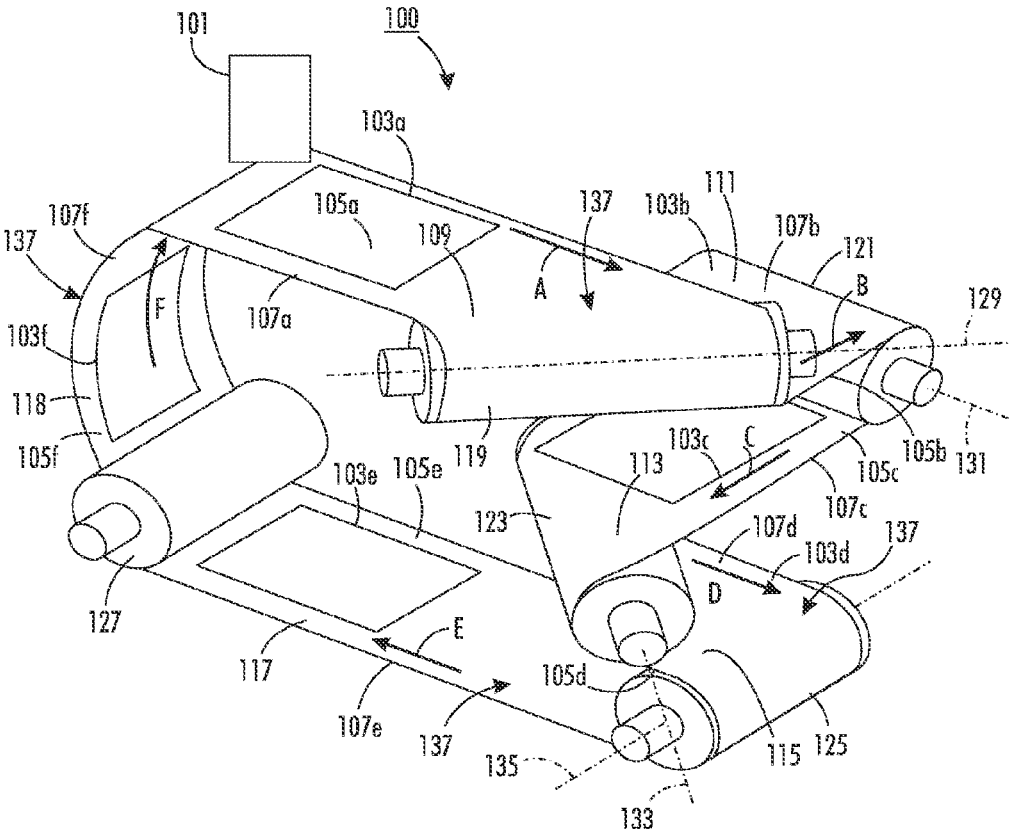
FIG. 1 is a diagram of a system capable of inverting a sheeted substrate while continuously running the sheeted substrate through a printing system, according to one embodiment.

FIG. 1 is a diagram of a system capable of inverting a sheeted substrate while continuously running the sheeted substrate through a printing system, according to one embodiment. Conventional printing systems invert or flip sheeted substrates to perform duplex printing. Conventional inversion of a sheeted substrate involves stopping a movement of the sheeted substrate to change directions of movement and to change a side of the sheeted substrate to be processed (i.e. receive a printed image). How the sheeted substrate is stopped is machine specific. For example, some cut sheet printing systems perform this inversion with a reversing roll type inverter. But, because the movement of the sheeted substrate is stopped and then restarted in another direction, the sheeted substrate must be accelerated to reach a process velocity. Printing service providers continue to increase printing process speeds to meet printing service demands.

However, continually increasing process speeds causes any associated accelerations that occur when the sheeted substrate changes directions to also rise. The increased speeds and accelerations often lead to handling issues such as paper jams because higher acceleration rates affect the system's ability to control the sheet. Increased speeds and accelerations also often cause image defects such as marring or smearing of the image, for example. Additionally, because conventional printing systems stop and restart the movement of a sheeted substrate to invert the sheeted substrate, maximum process speeds are limited.

Conventional solutions to compensate for increased speed include duplicating inverter paths in a printing system to lengthen the time a sheeted substrate is in an inverter portion of the printing system. Lengthening the inverter path reduces the acceleration needed to bring a stopped substrate up to process speed. This lengthening of the inverter path leads to increased cost, however. Additionally, duplicating hardware in the printing system makes the printing system more complex, more susceptible to failure, and increases its overall footprint. Further, such a solution still requires the sheeted substrate to be stopped for and inversion to occur.

To address this problem, a system 100 of FIG. 1 introduces the capability to invert a sheeted substrate while continuously running the sheeted substrate through a printing system. The system 100, as will be discussed in more detail below, uses a series of rolls oriented at about 45° and 90° angles with respect to a process direction that precedes a particular roll in combination with a drive system such as a belt on roller system, for example, to invert the sheeted substrate at a constant velocity. The system 100 may be configured to run at any speed, and in some embodiments be configured to process sheeted substrates at process speeds in excess of 180 pages per minute.

The constant velocity inversion of the sheeted substrate eliminates the need to stop and start the movement of the sheeted substrate to invert the sheeted substrate, such as in conventional inversion systems. Constant velocity inversion also eliminates the imposition of image defects caused by accelerating the sheeted substrate to return the movement of the sheeted substrate to process speed. Further, the constant velocity inversion also reduces the opportunity for paper jams to occur.

Inverting a continuous web-type substrate by way of using a series of stationary rolls at about 45° and 90° angles with respect to a process direction that precedes a particular roll is common in continuous web printing. The combinations of about 45° and 90° angles create a series of substantially 90° and 180° turns used to invert the web-type substrate. In web-type substrate inversion systems, the web-type substrate is not stopped and started, but rather is inverted during a continuous feeding process. Because the media is a web, it does not allow for stopping the sheet as in conventional sheeted substrate inversion systems. However, conventional continuous web printing inversion techniques are not applicable for sheeted substrates. Continuous web substrates are under a tension when processed by a printing system. The continuous web substrate is typically fed and drawn through a printing system, thereby pulling the webbed substrate over various rolls used to invert the webbed substrate.

Sheeted substrates, however, are not under the same tension when processed by a printing system. Therefore, a sheeted substrate will tend to drift as the sheeted substrate is fed through a conventional continuous web printing inversion system. Such drifting makes it difficult for a sheeted substrate to make the turns around the variously angled rolls of a continuous web-type substrate inversion system. As such, the drifting that occurs makes it difficult to invert a sheeted substrate using an inversion system developed for continuous web-type substrates. Additionally, drift may cause a number of image defects by way of abrasion or smearing, for example, as well as paper jams.

The system 100, therefore, uses one or more means for causing a sheeted substrate to make a series of substantially 90° and 180° turns to invert the sheeted substrate by way of 45° and 90° substantially oriented cylindrical rolls without the drift discussed above. The drift, or otherwise considered as slippage, may be prevented by a belt-drive system, a coating on any of the series of rolls, an air cushion formed between the sheeted substrate and a roll, or a tensioning means that mimics the tensioning that occurs in a continuous web inversion system, for example.

Accordingly, the system 100 completes an inversion of a sheeted substrate without stopping the sheeted substrate while inverting it, creates a continuous motion inversion for high speed cut sheet inversion which can reach a potential top end velocity of over 180 pages per minute for inversion because the system 100 does not decelerate, stop, and accelerate the sheeted substrate to invert it. Additionally, because the sheeted substrate does not have to stop to reverse direction, the system 100 eliminates an intercopy gap timing issue that is associated with conventional inversion techniques. For example, reversing the sheeted substrate requires a space between sheets to enable the inversion without sheet interference. Sheet interference occurs when the incoming and outgoing sheets occupy the same baffle space, thereby causing paper jams. The system 100 lowers the cost for high speed inversion because the system 100 eliminates the need to replicate inverters to lengthen inversion baffles and reduce g-forces caused by high acceleration rates of the sheeted substrate in systems where the sheet needs to stop and accelerate back to process speed. Further, because the system 100 is configured to perform continuous velocity inversion, the system 100 can accommodate long media without any issue of sheet interference due to intercopy gap and timing coordination errors associated with conventional inversion systems.

As shown in FIG. 1, the system 100 is a printing system that performs duplex printing on a sheeted substrate 103, according to one embodiment. The system 100 comprises a printing station 101 that is configured to apply an image to the sheeted substrate 103. The printing station 101 may be any form of printing station and may be exemplary of a xerographic print system, and inkjet print system, or any other type of printing system. The sheeted substrate 103 is illustrated and referred to as sheeted substrate 103*a*, 103*b*, 103*c*, 103*d*, 103*e* and 103*f* as the sheeted substrate 103 is advanced through the system 100 for ease of understanding.

The sheeted substrate 103 has a first surface 105 and a second surface 107. The system 100, as discussed above, inverts the sheeted substrate 103 such that an image may be applied to each of the first surface 105 and the second surface 107. As such, for ease of understanding the first surface 105 is referred to as first surface 105*a*, 105*b*, 105*c*, 105*d*, 105*e* and 105*f* as the sheeted substrate 103 is advanced through the system 100. In turn, the second surface 107 is referred to as second surface 107*a*, 107*b*, 107*c*, 107*d*, 107*e* and 107*f* as the substrate is advanced through the system 100.

In one or more embodiments, the system 100 comprises multiple process paths such as a first process path 109, second process path 111, third process path 113, fourth process path 115, fifth process path 117, and a return path 118. Each of the process paths are arranged in their own respective planes and all have their own process directions in which the sheeted substrate 103 is advanced when the sheeted substrate 103 is advanced along a particular process path. For example, sheeted substrate 103*a* moves in a process direction A when the sheeted substrate 103*a* is advanced along first process path 109. Sheeted substrate 103*b* moves in a process direction B when the sheeted substrate 103*b* is advanced along second process path 111. Sheeted substrate 103*c* moves in a process direction C when the sheeted substrate 103*c* is advanced along third process path 113. Sheeted substrate 103*d* moves in a process direction D when the sheeted substrate 103*d* is advanced along fourth process path 115. Sheeted substrate 103*e* moves in a process direction E when the sheeted substrate 103*e* is advanced along fifth process path 117. And sheeted substrate 103*f* moves in a process direction F when the sheeted substrate 103*f* is advanced along the return path 118.

According to various embodiments, the system 100, as discussed above, inverts the sheeted substrate 103 to facilitate duplex printing. However, in some embodiments, the system 100 may alternatively divert the sheeted substrate 103 in any direction at any moment while the sheeted substrate is advanced through the system 100, and need not cause the sheeted substrate to be fed through all of the process paths for duplex printing.

In some embodiments, the system 100 comprises a series of rolls including a first roll 119, a second roll 121, a third roll 123, and a fourth roll 125. The system 100 may also comprise a return mechanism 127 that may itself be a roll that causes the sheeted substrate 103 to be returned to the first process path 109 following a continuous inversion process. In one or more embodiments, the return mechanism 127 may be a series of belts, or conveyors, for example, rather than a roll such as that illustrated in FIG. 1.

Each of the first roll 119, second roll 121, third roll 123, and fourth roll 125 have respective center axes such as first roll center axis 129, second roll center axis 131, third roll center axis 133 and fourth roll center axis 135. In one or more embodiments, all of the first roll 119, second roll 121, third roll 123 and fourth roll 125 may be stationary to prevent substrate drift as the sheeted substrate 103 is caused to pass over them. Or, any of the first roll 119, second roll 121, third roll 123 and fourth roll 125 may be configured to rotate about its respective centerline, and substrate drift, if it occurs, may be prevented by some other means such as a tensioning or belt guidance mechanism 137, air cushioning, or a coating on one or more of the first roll 119, second roll 121, third roll 123, fourth roll 125 and/or in the return mechanism 127, for example.

According to various embodiments, the sheeted substrate 103*a* is fed along the first process path 109 in a first plane in the first process direction A, the sheeted substrate 103*a* has a first orientation in which the first surface 105*a* faces a first direction and the second surface 107*a* faces a second direction. The first direction may be, for example, a direction facing the printing station 101 discussed above. The second direction may be a direction opposite that of the first direction. The sheeted substrate 103 is advanced around the first roll 119 having the first roll center axis 129 oriented at about a 45° angle with respect to the first process direction A. The first roll 119 causes the sheeted substrate 103 to be diverted from the first process path 109 to the second process path 111. The second process path 111 is perpendicular to the first process direction A, or in other words, the sheeted substrate 103 is caused to turn substantially 90° thereby becoming sheeted substrate 103*b*.

The sheeted substrate 103*b* is fed in the second process direction B along the second process path 111, the second process direction B is perpendicular to the first process direction A. The second process path 111, as discussed above, is in a plane different that of any of the other process paths. When the first roll 119 causes the sheeted substrate 103 to be diverted from the first process path 109 to the second process path 111, the sheeted substrate 103 is inverted such that the sheeted substrate 103 is flipped from the first orientation of sheeted substrate 103*a* to a second orientation of sheeted substrate 103*b* in which the first surface 105*b* faces the second direction and the second surface 107*b* faces the first direction.

The sheeted substrate 103*b* is fed along the second process path 111 in the second process direction B to the second roll 121. The sheeted substrate 103 is advanced around the second roll 121 having the second roll center axis 131 oriented at about a 90° angle with respect to the second process direction B. The second roll 121 causes the sheeted substrate 103 to be diverted from the second process path 111 to the third process path 113. The third process path 113 is parallel to the second process direction B, but is opposite in direction, or in other words, the sheeted substrate 103 is caused to turn 180° thereby becoming sheeted substrate 103*c*.

The sheeted substrate 103*c* is fed in the third process direction C along the third process path 113, the third process direction C is parallel to the second process direction B. The third process path 113, as discussed above, is in a plane different that of any of the other process paths. When the second roll 121 causes the sheeted substrate 103 to be diverted from the second process path 111 to the third process path 113, the sheeted substrate 103 is inverted such that the sheeted substrate 103 is flipped from the second orientation of sheeted substrate 103*b* to a third orientation of sheeted substrate 103*c* in which the first surface 105*c* faces the first direction and the second surface 107*c* faces the second direction.

The sheeted substrate 103*c* is fed along the third process path 113 in the third process direction C to the third roll 123. The sheeted substrate 103 is advanced around the third roll 123 having the third roll center axis 133 oriented at about a 45° angle with respect to the third process direction C. The third roll 123 causes the sheeted substrate 103 to be diverted from the third process path 113 to the fourth process path 115. The fourth process path 115 is perpendicular to the third process direction C, or in other words, the sheeted substrate 103 is caused to turn substantially 90° thereby becoming sheeted substrate 103*d*.

The sheeted substrate 103*d* is fed in the fourth process direction D along the fourth process path 115, the fourth process direction D is perpendicular to the third process direction C. The fourth process path 115, as discussed above, is in a plane different that of any of the other process paths. When the third roll 123 causes the sheeted substrate 103 to be diverted from the third process path 113 to the fourth process path 115, the sheeted substrate 103 is inverted such that the sheeted substrate 103 is flipped from the third orientation of sheeted substrate 103*c* to a fourth orientation of sheeted substrate 103*d* in which the first surface 105*d* faces the second direction and the second surface 107*d* faces the first direction.

The sheeted substrate 103*d* is fed along the fourth process path 115 in the fourth process direction D to the fourth roll 125. The sheeted substrate 103 is advanced around the fourth roll 125 having the fourth roll center axis 135 oriented at about a 90° angle with respect to the fourth process direction D. The fourth roll 125 causes the sheeted substrate 103 to be diverted from the fourth process path 115 to the fifth process path 117. The fifth process path 117 is parallel to the fourth process direction D, but is opposite in direction, or in other words, the sheeted substrate 103 is caused to turn 180° thereby becoming sheeted substrate 103*e*.

The sheeted substrate 103*e* is fed in the fifth process direction E along the fifth process path 117. The fifth process path 117, as discussed above, is in a plane different that of any of the other process paths. When the fourth roll 125 causes the sheeted substrate 103 to be diverted from the fourth process path 115 to the fifth process path 117, the sheeted substrate 103 is inverted such that the sheeted substrate 103 is flipped from the fourth orientation of sheeted substrate 103*d* to a fifth orientation of sheeted substrate 103*e* in which the first surface 105*e* faces the first direction and the second surface 107*e* faces the second direction.

The sheeted substrate 103*e* is fed along the fifth process path 117 in the fifth process direction E to the return mechanism 127, which is illustrated as being a roll. Though, as discussed above, the return mechanism 127 may comprise any number of rolls, or any other means by which the sheeted substrate may be moved from the fifth process path 117 to the first process path 109. The sheeted substrate 103 is advanced, for example, around the roll of the return mechanism 127 which may have a roll center axis oriented at about a 90° angle with respect to the fifth process direction E. The return mechanism 127, regardless of configuration, causes the sheeted substrate 103 to be diverted from the fifth process path 117 to the return path 118, thereby becoming sheeted substrate 103*f*.

Sheeted substrate 103*f* is advanced in process direction F which returns sheeted substrate 103 to the first process path 109. The return mechanism 127 causes the sheeted substrate 103 to again be inverted from the fifth orientation of sheeted substrate 103*f* to a sixth orientation of the sheeted substrate 103 (which is not shown to avoid obscuring that which is shown in FIG. 1, but should be understood to be an orientation opposite that of the first orientation of sheeted substrate 103*a*) in which the first surface (for example 105*a*) faces the second direction and the second surface (for example 107*a*) faces the first direction.

In one or more embodiments, though FIG. 1 illustrates a complete revolution of the sheeted substrate 103 from the first process path 109 through the system 100 back to the first process path 109 while being continuously inverted, the system 100 may be configured to accommodate any number of turns and cause the sheeted substrate 103 to be diverted to another process path rather than being caused to return to the first process path 109 for duplex printing in the first process path 109.

Figure 2:
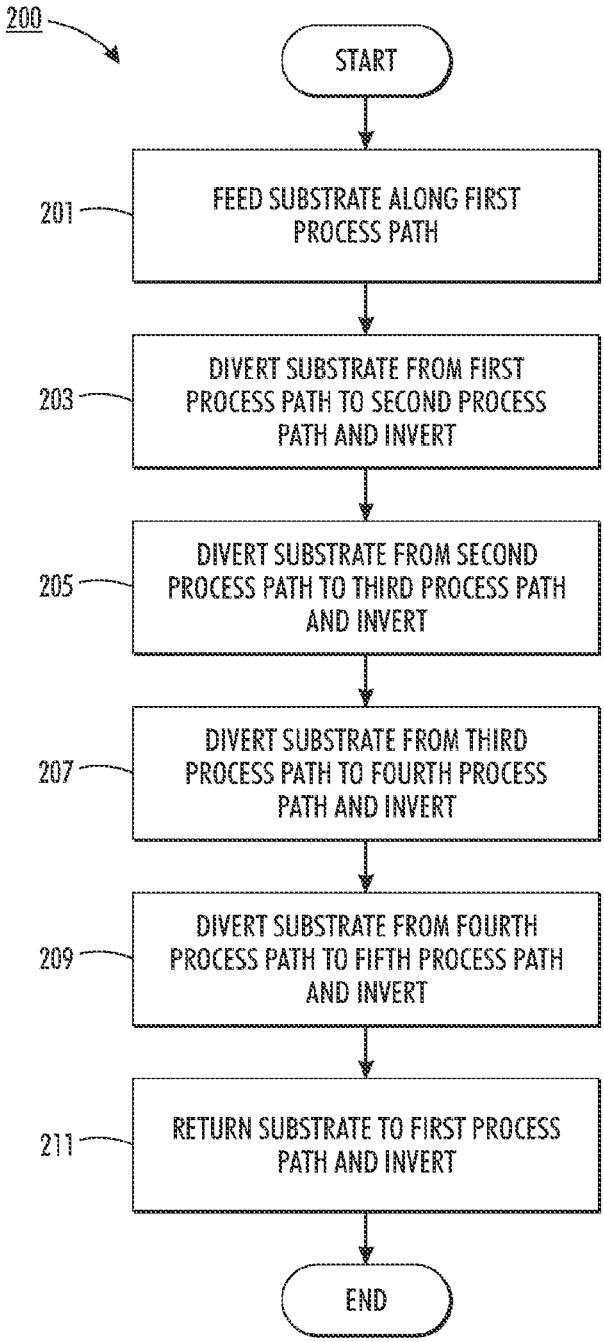
FIG. 2 is a flowchart of a process for inverting a sheeted substrate while continuously running the sheeted substrate through a printing system, according to one embodiment.
Figure 3:
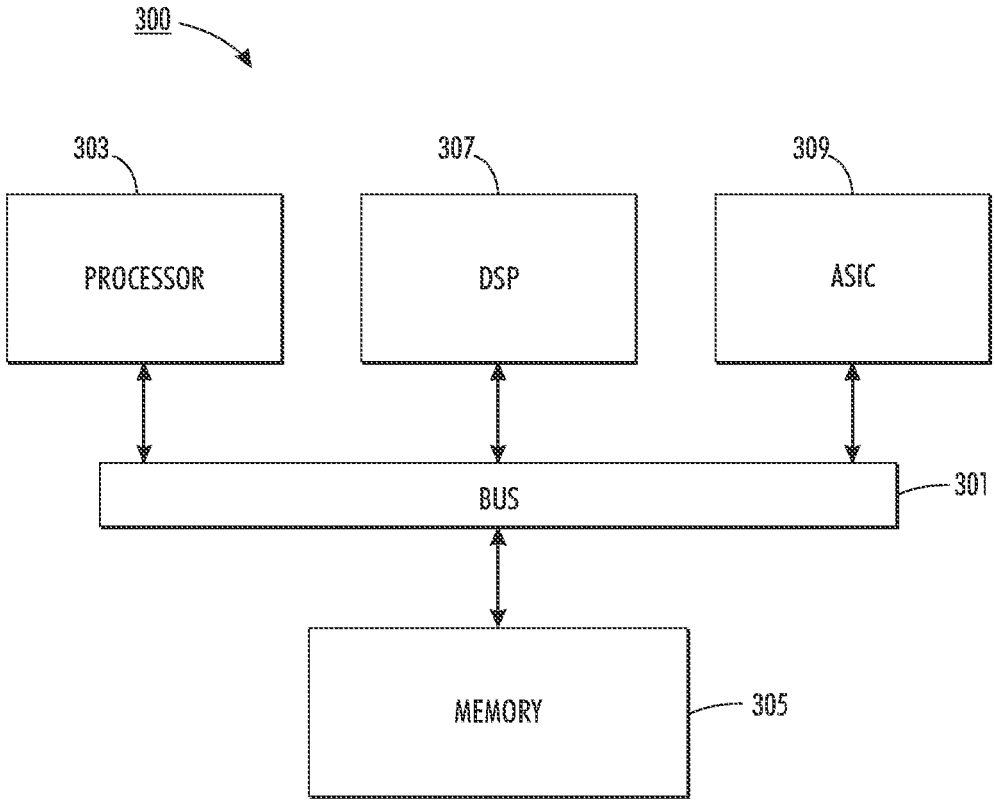
FIG. 3 is a diagram of a chip set that can be used to implement an embodiment.

FIG. 2 is a flowchart of a process for inverting a sheeted substrate while continuously running the sheeted substrate through a printing system, according to one embodiment. In one embodiment, the process 200 may be performed by the system 100 or a control module implemented in, for instance, a chip set including a processor and a memory as shown in FIG. 3. In step 201, the system 100 causes, at least in part, the sheeted substrate 103 having the first surface 105 and the second surface 107 to be fed in the first process direction A along the first process path 109 in a first plane at any configurable process speed which, for example, may be greater than 180 pages per minute. The sheeted substrate 103 has a first orientation in which the first surface 105 faces a first direction and the second surface 107 faces a second direction.

Then, in step 203, the system 100 causes, at least in part, the sheeted substrate to be fed in the second process direction B along the second process path 111 perpendicular to the first process direction A in a second plane. The system 100 causes the diversion of the sheeted substrate 103 from the first process path 109 to the second process path 111 by way of the first roll 119 having the first roll center axis 129 oriented at about a 45° angle with respect to the first process direction A. The first roll 119 also causes the substrate to be inverted from the first orientation to a second orientation in which the first surface 105 faces the second direction and the second surface 107 faces the first direction.

Next, in step 205, the system 100 causes, at least in part, the sheeted substrate 103 to be fed in the third process direction C along the third process path 113 parallel to the second process direction B in a third plane. The system 100 causes the sheeted substrate 103 to be diverted from the second process path 111 to the third process path 113 by way of the second roll 121 having a second roll center axis 131 oriented at about a 90° angle with respect to the second process direction B. The second roll 121 is configured to cause sheeted substrate 103 to be inverted from the second orientation to a third orientation in which the first surface 105 faces the first direction and the second surface 107 faces the second direction.

The process continues to step 207 in which the system 100 causes, at least in part, the sheeted substrate 103 to be fed in a fourth process direction D along a fourth process path 115 perpendicular to the third process direction C in a fourth plane. The system 100 causes the sheeted substrate 103 to be diverted from the third process path 113 to the fourth process path 115 by way of a third roll 123 having a third roll center axis 133 oriented at about a 45° angle with respect to the third process direction C. The system 100 causes the sheeted substrate 103 to be inverted from the third orientation to a fourth orientation in which the first surface 105 faces the second direction and the second surface 107 faces the first direction.

Then, in step 209, the system 100 causes, at least in part, the sheeted substrate 103 to be fed in a fifth process direction E along a fifth process path 117 parallel to the fourth process direction D in a fifth plane. The system 100 causes the sheeted substrate 103 to be diverted from the fourth process path 115 to the fifth process path 117 by way of a fourth roll 125 having a fourth roll center axis 135 oriented at about a 90° angle with respect to the fourth process direction D. The system 100 causes the sheeted substrate 103 to be inverted from the fourth orientation to a fifth orientation in which the first surface 105 faces the first direction and the second surface 107 faces the second direction.

Next, in step 211, the system 100 causes, at least in part, the return mechanism 127 to return the sheeted substrate 103 to the first process path 109 so that the sheeted substrate 103 is fed in the first process direction A while inverted compared such that the first surface 105 faces the second direction and the second surface 107 faces the first direction.

It should be noted that the substrate 103 may be diverted to any bypass path at any time after any number of turns through any number of rolls and need not continue through the entire loop to be completely inverted and return to the first process path 109, for example.

The processes described herein for inverting a sheeted substrate while continuously running the sheeted substrate through a printing system may be advantageously implemented via software, hardware, firmware or a combination of software and/or firmware and/or hardware. For example, the processes described herein, may be advantageously implemented via processor(s), Digital Signal Processing (DSP) chip, an Application Specific Integrated Circuit (ASIC), Field Programmable Gate Arrays (FPGAs), etc. Such exemplary hardware for performing the described functions is detailed below.

FIG. 3 illustrates a chip set or chip 300 upon which an embodiment may be implemented. Chip set 300 is programmed to invert a sheeted substrate while continuously running the sheeted substrate through a printing system as described herein may include, for example, bus 301, processor 303, memory 305, DSP 307 and ASIC 309 components.

The processor 303 and memory 305 may be incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/ or limitation of electrical interaction. It is contemplated that in certain embodiments the chip set 300 can be implemented in a single chip. It is further contemplated that in certain embodiments the chip set or chip 300 can be implemented as a single "system on a chip." It is further contemplated that in certain embodiments a separate ASIC would not be used, for example, and that all relevant functions as disclosed herein would be performed by a processor or processors. Chip set or chip 300, or a portion thereof, constitutes a means for performing one or more steps of inverting a sheeted substrate while continuously running the sheeted substrate through a printing system.

In one or more embodiments, the chip set or chip 300 includes a communication mechanism such as bus 301 for passing information among the components of the chip set 300. Processor 303 has connectivity to the bus 301 to execute instructions and process information stored in, for example, a memory 305. The processor 303 may include one or more processing cores with each core configured to perform independently. A multi-core processor enables multiprocessing within a single physical package. Examples of a multi-core processor include two, four, eight, or greater numbers of processing cores. Alternatively or in addition, the processor 303 may include one or more microprocessors configured in tandem via the bus 301 to enable independent execution of instructions, pipelining, and multithreading. The processor 303 may also be accompanied with one or more specialized components to perform certain processing functions and tasks such as one or more digital signal processors (DSP) 307, or one or more application-specific integrated circuits (ASIC) 309. A DSP 307 typically is configured to process real-world signals (e.g., sound) in real time independently of the processor 303. Similarly, an ASIC 309 can be configured to performed specialized functions not easily performed by a more general purpose processor. Other specialized components to aid in performing the inventive functions described herein may include one or more field programmable gate arrays (FPGA), one or more controllers, or one or more other special-purpose computer chips.

In one or more embodiments, the processor (or multiple processors) 303 performs a set of operations on information as specified by computer program code related to inverting a sheeted substrate while continuously running the sheeted substrate through a printing system. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 301 and placing information on the bus 301. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 303, such as a sequence of operation codes, constitute processor instructions, also called computer system instructions or, simply, computer instructions. Processors may be implemented as mechanical, electrical, magnetic, optical, chemical or quantum components, among others, alone or in combination.

The processor 303 and accompanying components have connectivity to the memory 305 via the bus 301. The memory 305 may include one or more of dynamic memory (e.g., RAM, magnetic disk, writable optical disk, etc.) and static memory (e.g., ROM, CD-ROM, etc.) for storing executable instructions that when executed perform the inventive steps described herein to invert a sheeted substrate while continuously running the sheeted substrate through a printing system. The memory 305 also stores the data associated with or generated by the execution of the inventive steps.

In one or more embodiments, the memory 305, such as a random access memory (RAM) or any other dynamic storage device, stores information including processor instructions for inverting a sheeted substrate while continuously running the sheeted substrate through a printing system. Dynamic memory allows information stored therein to be changed by system 100. RAM allows a unit of information stored at a location called a memory address to be stored and retrieved independently of information at neighboring addresses. The memory 305 is also used by the processor 303 to store temporary values during execution of processor instructions. The memory 305 may also be a read only memory (ROM) or any other static storage device coupled to the bus 301 for storing static information, including instructions, that is not changed by the system 100. Some memory is composed of volatile storage that loses the information stored thereon when power is lost. The memory 305 may also be a non-volatile (persistent) storage device, such as a magnetic disk, optical disk or flash card, for storing information, including instructions, that persists even when the system 100 is turned off or otherwise loses power.

The term "computer-readable medium" as used herein refers to any medium that participates in providing information to processor 303, including instructions for execution. Such a medium may take many forms, including, but not limited to computer-readable storage medium (e.g., non-volatile media, volatile media), and transmission media. Non-volatile media includes, for example, optical or magnetic disks. Volatile media include, for example, dynamic memory. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

While a number of embodiments and implementations have been described, the invention is not so limited but covers various obvious modifications and equivalent arrangements, which fall within the purview of the appended claims. Although features of various embodiments are expressed in certain combinations among the claims, it is contemplated that these features can be arranged in any combination and order.

What is claimed is:

1. An image forming device, comprising:

a printing station that applies marking material to create images on non-continuous web individual sheeted substrates, the marking material being applied to a first surface of the sheeted substrate on a first pass through the printing station;

an individual sheeted substrate transport mechanism comprising a belt that is threaded around a series of rolls to form an individual sheeted substrate transport path that includes:

the belt extending in a first process direction in a first plane along which a sheeted substrate having the first surface and a second surface is transported from an exit of the printing station, the sheeted substrate having a first orientation in which the first surface faces a first direction and the second surface faces a second direction;

the belt partially surrounding a first roll of the series of rolls, the first roll having a first roll center axis oriented substantially at a 45° angle with respect to the first process direction;

the belt extending from the first roll in a second process direction perpendicular to the first process direction along which the sheeted substrate is transported in a second plane, the first roll being configured to cause a first diversion of the belt from the first process direction to the second process direction, causing a first inversion of the sheeted substrate from the first orientation to a second orientation in which the first surface faces the second direction and the second surface faces the first direction;

the belt partially surrounding a second roll having a second roll center axis oriented substantially at a 90° angle with respect to the second process direction;

the belt extending from the second roll in a third process direction parallel to the second process direction along which the sheeted substrate is transported in a third plane, the second roll being configured to cause a second diversion of the belt from the second process direction to the third process direction, causing a second inversion of the sheeted substrate from the second orientation back to the first orientation;

the belt partially surrounding a third roll having a third roll center axis oriented substantially at a 45° angle with respect to the third process direction;

the belt extending from the third roll in a fourth process direction perpendicular to the third process direction along which the sheeted substrate is transported in a fourth plane, the third roll being configured to cause a third diversion of the belt from the third process direction to the fourth process direction, causing a third inversion of the sheeted substrate from the first orientation again to the second orientation;

the belt partially surrounding a fourth roll having a fourth roll center axis oriented substantially at a 90° angle with respect to the fourth process direction;

the belt extending from the fourth roll in a fifth process direction parallel to the fourth process direction along which the sheeted substrate is transported in a fifth plane, the, the fourth roll being configured to cause a fourth diversion of the sheeted substrate from the fourth process direction to the fifth process direction, causing a fourth inversion of the sheeted substrate from the second orientation to the first orientation;

a return mechanism configured to return the sheeted substrate on the belt to the printing station in the first process direction, causing a fifth inversion of the sheeted substrate from the first orientation to the second orientation, and presenting the sheeted substrate to the printing station in the second orientation such that the marking material is applied to the second surface of the sheeted substrate on a second pass through the printing station; and at least one sheet diverting device that diverts the sheeted substrate off the belt at a position in the individual sheeted substrate transport path downstream of the printing station.

2. The image forming device of claim 1, the return mechanism comprising at least one other roll.

3. The image forming device of claim 1, one or more of the first roll, the second roll, the third roll, and the fourth roll being stationary.

4. The image forming device of claim 1, one or more of the first roll, the second roll, the third roll, and the fourth roll being configured to substantially prevent the sheeted substrate from traveling in a direction parallel to the respective first roll center axis, second roll center axis, third roll center axis, and fourth roll center axis.

5. The image forming device of claim 1, the individual sheeted substrates being transported along the individual sheeted substrate transport path from the printing station at a speed greater than 180 individual pages per minute.

6. A method for transporting individual sheeted substrates in an image forming system, comprising:

transporting a sheeted substrate on a belt in a first process direction from an exit of a printing station in a first plane, the sheeted substrate having (1) a first surface on which marking material is deposited by the printing station on a first pass through the printing station to form an image, and (2) a first orientation in which the first surface faces a first direction and the second surface faces a second direction;

transporting the sheeted substrate with the belt in a second process direction perpendicular to the first process direction in a second plane, the belt partially surrounding a first roll having a first roll center axis oriented substantially at a 45° angle with respect to the first process direction, the first roll being configured to cause a first diversion of the belt from the first process direction to the second process path, and to cause a first inversion of the sheeted substrate from the first orientation to a second orientation in which the first surface faces the second direction and the second surface faces the first direction;

transporting the sheeted substrate with the belt in a third process direction parallel to the second process direction in a third plane, the belt partially surrounding a second roll having a second roll center axis oriented substantially at a 90° angle with respect to the second process direction, the second roll being configured to cause a second diversion of the belt from the second process direction to the third process direction, and to cause a second inversion of the sheeted substrate from the second orientation to the first orientation;

transporting the sheeted substrate with the belt in a fourth process direction perpendicular to the third process direction in a fourth plane, the belt partially surrounding a third roll having a third roll center axis oriented substantially at a 45° angle with respect to the third process direction, the third roll being configured to cause a third diversion of the belt from the third process direction to the fourth process direction, and to cause a third inversion of the sheeted substrate from the first orientation to the second orientation;

transporting the sheeted substrate with the belt in a fifth process direction parallel to the fourth process direction in a fifth plane, the belt partially surrounding a fourth roll having a fourth roll center axis oriented substantially at a 90° angle with respect to the fourth process direction, the fourth roll being configured to cause a fourth diversion of the belt from the fourth process direction to the fifth process direction, and to cause a fourth inversion of the sheeted substrate from the second orientation to the first orientation;

transporting the sheeted substrate with the belt through a return mechanism to return the sheeted substrate to the printing station in the first process direction, the return mechanism causing a fifth inversion of the sheeted substrate from the first orientation to the second orientation such that the marking material is applied to the second surface of the sheeted substrate on a second pass through the printing station; and diverting the sheeted substrate off the belt at a position downstream of the printing station after one of the first sass or the second sass through the printing station.

7. The method of claim 6, the return mechanism comprising at least one other roll.

8. The method of claim 6, one or more of the first roll, the second roll, the third roll, and the fourth roll being stationary.

9. The method of claim 6, one or more of the first roll, the second roll, the third roll, and the fourth roll being configured to substantially prevent the sheeted substrate from traveling in a direction parallel to the respective first roll center axis, second roll center axis, third roll center axis, and fourth roll center axis.

10. The method of claim 6, the sheeted substrates being transported from the printing station at a speed greater than 180 individual pages per minute.

* * * * *